US007636535B2

(12) United States Patent
Kunihiro et al.

(10) Patent No.: US 7,636,535 B2
(45) Date of Patent: Dec. 22, 2009

(54) DEVELOPING UNIT

(75) Inventors: Hisashi Kunihiro, Nara (JP); Toshihide Ohgoshi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 498 days.

(21) Appl. No.: 11/700,896

(22) Filed: Feb. 1, 2007

(65) Prior Publication Data

US 2007/0212115 A1 Sep. 13, 2007

(30) Foreign Application Priority Data

Mar. 10, 2006 (JP) ..... 2006-065624

(51) Int. Cl.
*G03G 15/08* (2006.01)

(52) U.S. Cl. ..... 399/254; 399/256

(58) Field of Classification Search ..... 399/107, 399/119, 120, 252, 253, 254, 255, 256
See application file for complete search history.

(56) References Cited

U.S. PATENT DOCUMENTS 4,583,842 A 4/1986 Shimono et al.
5,220,382 A * 6/1993 Hediger ..... 399/256
7,463,852 B2 * 12/2008 Yoshida et al. ..... 399/254

FOREIGN PATENT DOCUMENTS

JP 7-28321 * 1/1995
JP 8-220887 A 8/1996
JP 2000-137383 5/2000
JP 2004-37997 A 2/2004

* cited by examiner

*Primary Examiner*—Hoan H Tran
(74) *Attorney, Agent, or Firm*—Nixon & Vanderhye, P.C.

(57) ABSTRACT

A developing unit including: a first agitating and conveying rotor and second agitating and conveying rotor for agitating and conveying toner inside a casing; and a developing roller for supplying the toner to a photoreceptor drum is constructed such that the first agitating and conveying rotor has a rotary shaft arranged approximately parallel to the developing roller and a multiple number of agitating vanes arranged on the rotary shaft with an inclination to the axial direction of the rotary shaft; each agitating element is formed asymmetrically about a normal that passes through the rotational center and adjacent agitating elements are asymmetrical to each other; and an odd number of asymmetrical agitating elements are arranged alternately.

6 Claims, 14 Drawing Sheets b5
232b5
232b3
b5
232B2
232b2
232C2
232b3
b4
232
232b4
b4
232b2
232a
b3
232B1
232b3
232C1
b2
b3
232b2
b1
b2
232b1
b1

L1
232b1
232a

L1
232b2
232a
232b21

L1
232b31
232b3
232a

L1
232c
232a
232b4
232c

L1
232a
232b5

DEVELOPING UNIT

This Nonprovisional application claims priority under 35 U.S.C. § 119(a) on Patent Application No. 2006-65624 filed in Japan on 10 Mar. 2006, the entire contents of which are hereby incorporated by reference.

BACKGROUND OF THE INVENTION (1) Field of the Invention

The present invention relates to a developing unit, in particular relating to a developing unit for use in an image forming apparatus for performing image formation with toner.

(2) Description of the Prior Art

Conventionally, in image forming apparatuses based on the electrophotography using toner, such as copiers, facsimile machines, etc., a developer is supplied as appropriate from a developing unit to an electrostatic latent image that is formed on a photoreceptor in accordance with image information so as to visualize it, and this developer image is in turn transferred to a recording medium to thereby achieve image output.

Typically, the developer is comprised of a developer hopper for storing a developer (including toner) therein, an agitating and conveying means for conveying the developer in the developer hopper while agitating it with a screw etc., and a developing roller for supplying the developer to a photoreceptor, and supplies an appropriate amount of the developer that has been uniformly agitated in the developer hopper to the electrostatic latent image bearer (photoreceptor drum).

However, in the conventional developing unit, for example in a case where the developer is conveyed whilst being agitated with a screw etc., the developer is more likely to stagnate on the terminating end side than on the starting end side of conveyance. Accordingly, the quantity distribution of the developer inside the developer hopper becomes imbalance, or the developer tends to gather to the downstream side with respect to the direction of conveyance, causing image failures if high-speed printing is performed.

Also, since conveyance of the developer inside the developer hopper by the agitating and conveying means suffers the problem that exchange of the developer to be conveyed cannot be reliably and smoothly done, hence circulation of the developer becomes poor and the efficiency of conveyance lowers, this configuration faces difficulties in dealing with the recent high-speed trend of image output.

To deal with the aforementioned conventional problems, there has been a known configuration (see patent document 1: Japanese Patent Application Laid-open 2000-137383) which, in order to secure good circulation of the developer inside the developing hopper, includes a main conveying means for conveying the developer, made up of a first agitating and conveying means for conveying the developer in one direction inside the developer hopper and a second agitating and conveying means for conveying the developer in the direction opposite to the direction in which the developer is conveyed by the first agitating and conveying means, and arranged so that the terminating end of developer conveyance by the first agitating and conveying means and the terminating end of developer conveyance by the second agitating and conveying means are located at positions more inwards than the ends of the effective agitation and conveyance by the agitators.

However, the above-described conventional configuration not only needs a greater number of apparatus components but also increases complexity in machine structure, hence suffers difficulties in achieving space-saving.

SUMMARY OF THE INVENTION

The present invention has been devised in view of the above conventional problems, it is therefore an object of the present invention to provide a developing unit with a simple configuration, which permits the developer in a developer hopper to be agitated and conveyed highly efficiently so as to achieve good circulation of the developer and can realize high-quality image formation upon high-speed printing without causing any imbalance in developer distribution.

The developing unit according to the present invention for solving the above problems is configured as follows.

A developing unit according to the first aspect of the present invention includes: an agitating and conveying portion for conveying a developer stored in a developing hopper while agitating the developer; and a developing roller for supplying the developer conveyed from the agitating and conveying portion to an electrostatic latent image bearer, and is characterized in that the agitating and conveying portion comprises a rotary shaft arranged approximately parallel to the developing roller and a plurality of separate plate-like agitating elements arranged with an inclination with respect to the extended direction of axis of the rotary shaft; each of an odd number of agitating elements arranged in series among the plural agitating elements is formed in a shape asymmetrical with respect to a normal line that is perpendicular to the tangent of the contour of the corresponding agitating element and passes through the rotational center of the rotary shaft; and the agitating elements adjacent to each other in the odd number of agitating elements are arranged on the rotary shaft with their phases made different.

A developing unit according to the second aspect of the present invention is characterized in that, in addition to the configuration described in the above first aspect, the odd number of agitating elements arranged in series are formed as a first set on the first side and a second set on the second side, on both sides, bounded at the approximate center of the agitated area of the agitating and conveying portion; the order of arrangement of the agitating elements in the second set with respect to the direction toward the approximate center is asymmetrical to that of the agitating elements of the first set; and the first and second sets are adapted to convey the developer toward the approximate center.

A developing unit according to the third aspect of the present invention is characterized in that, in addition to the configuration described in the above first or second aspect, the developing unit further includes a toner concentration sensor disposed close to the agitating and conveying portion, and the agitating element disposed close to the toner concentration sensor is formed with a cutout at a position opposing the toner concentration sensor.

A developing unit according to the fourth aspect of the present invention is characterized in that, in addition to the configuration described in any one of the above first to third aspects, the agitating elements arranged at both ends of the agitating and conveying portion are each formed in a hemi-elliptic shape with symmetry about the normal line.

A developing unit according to the fifth aspect of the present invention is characterized in that, in addition to the configuration described in the above fourth aspect, the agitating element at the approximate center of the rotary shaft among the multiple agitating elements is formed as an approximate circular plate.

A developing unit according to the sixth aspect of the present invention is characterized in that, in addition to the configuration described in any one of the above first to fifth aspects, the agitating elements are arranged with an inclination of 45 degrees with respect to the axial direction of the rotary shaft.

According to the first aspect of the present invention, each of an odd number of agitating elements arranged in series among the plural agitating elements is formed in a shape asymmetrical with respect to a normal line that is perpendicular to the tangent of the contour of the corresponding agitating element and passes through the rotational center of the rotary shaft or in other word, point symmetrical about the rotational center, and the agitating elements adjacent to each other in the odd number of agitating elements are arranged on the rotary shaft with their phases made different. This configuration enables individual agitating elements to produce conveying forces along the axial direction of the rotary shaft and to convey the developer in individual predetermined directions while agitating, by disturbing the constant flow of the developer as a whole. Hence it is possible with a simple configuration to permit the developer in the developer hopper to be agitated and conveyed highly efficiently, achieve good circulation of the developer and realize high-quality image formation upon high-speed printing without causing any imbalance in developer distribution.

In addition to the above common effect that is obtained from the first to sixth aspects of the invention, each aspect of the invention has the following effect.

Detailedly, according to the second aspect of the invention, in addition to the effect achieved by the first aspect of the invention, it is possible to prevent occurrence of image failures due to unbalanced distribution of the developer to the downstream of the inclination if the vanes are disposed with an inclination with respect to the axial direction of the rotary axis.

According to the third aspect of the invention, in addition to the effect achieved by the first or second aspect of the invention, it is possible to prevent output ripples at the toner concentration sensor due to change in magnetic permeability as the developer conveyed by the agitating elements varies in density. As a result, correct toner concentration can be detected.

According to the fourth aspect of the invention, in addition to the effect achieved by any one of the first to third aspects of the invention, it is possible to maximize the conveying force of each agitating element and hence convey the developer stably.

According to the fifth aspect of the invention, in addition to the effect achieved by the fourth aspect of the invention, by agitating the developer without its being conveyed at the center of the agitated area, it is possible to agitate the developer more uniformly.

According to the sixth aspect of the invention, in addition to the effect achieved by any one of the first to fifth aspects of the invention, it is possible to agitate and convey the developer highly efficiently.

DESCRIPTION OF THE PREFERRED EMBODIMENTS

The best mode for carrying out the present invention will be described with reference to the drawings.

Figure 1:
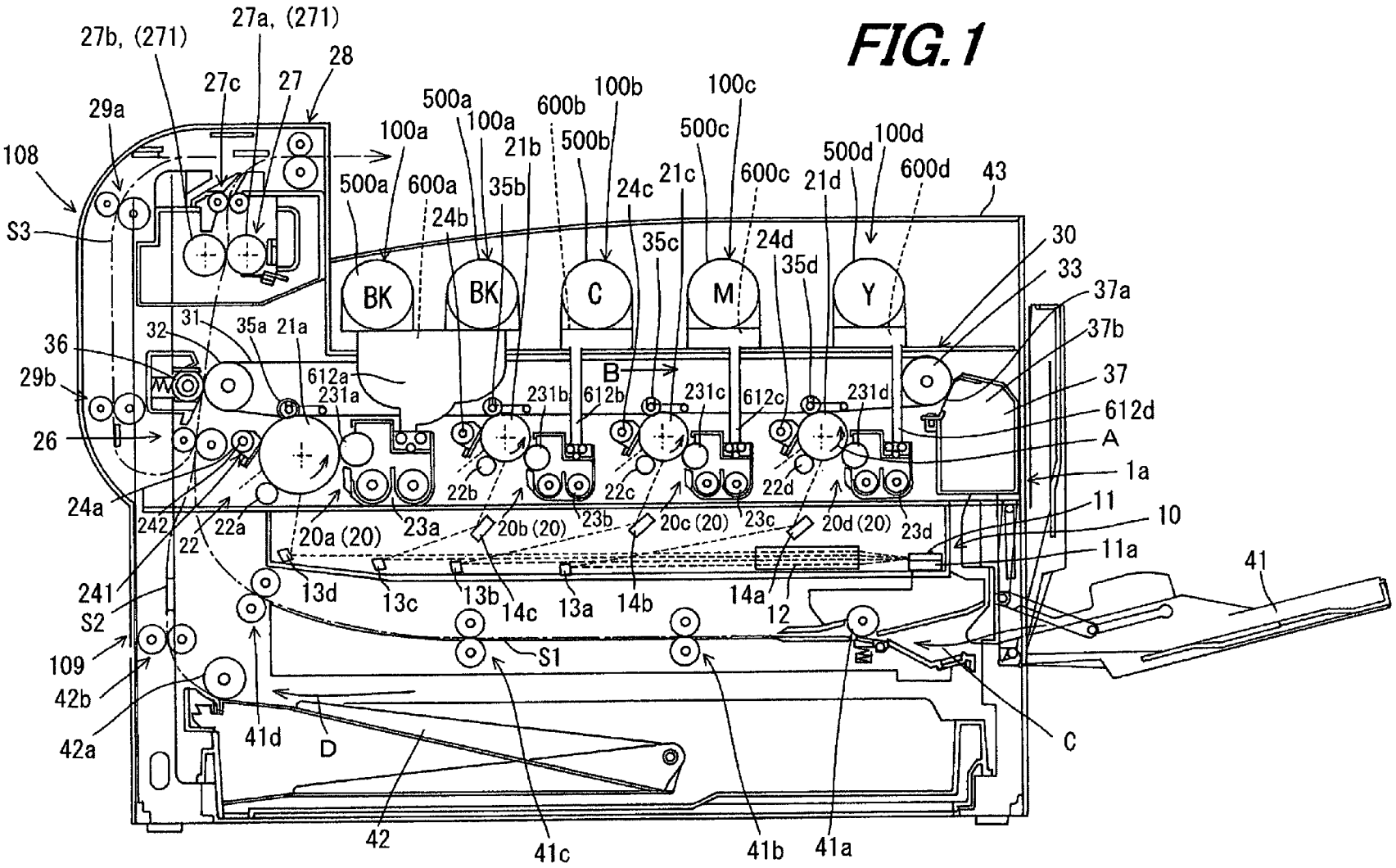
FIG. 1 is an illustrative view showing an overall configuration of an image forming apparatus adopting a toner supply device according to the present invention.

FIG. 1 is an example of the mode for carrying out the present invention, and is an illustrative view showing an overall configuration of an image forming apparatus adopting a developing unit according to the present invention.

Figure 3:
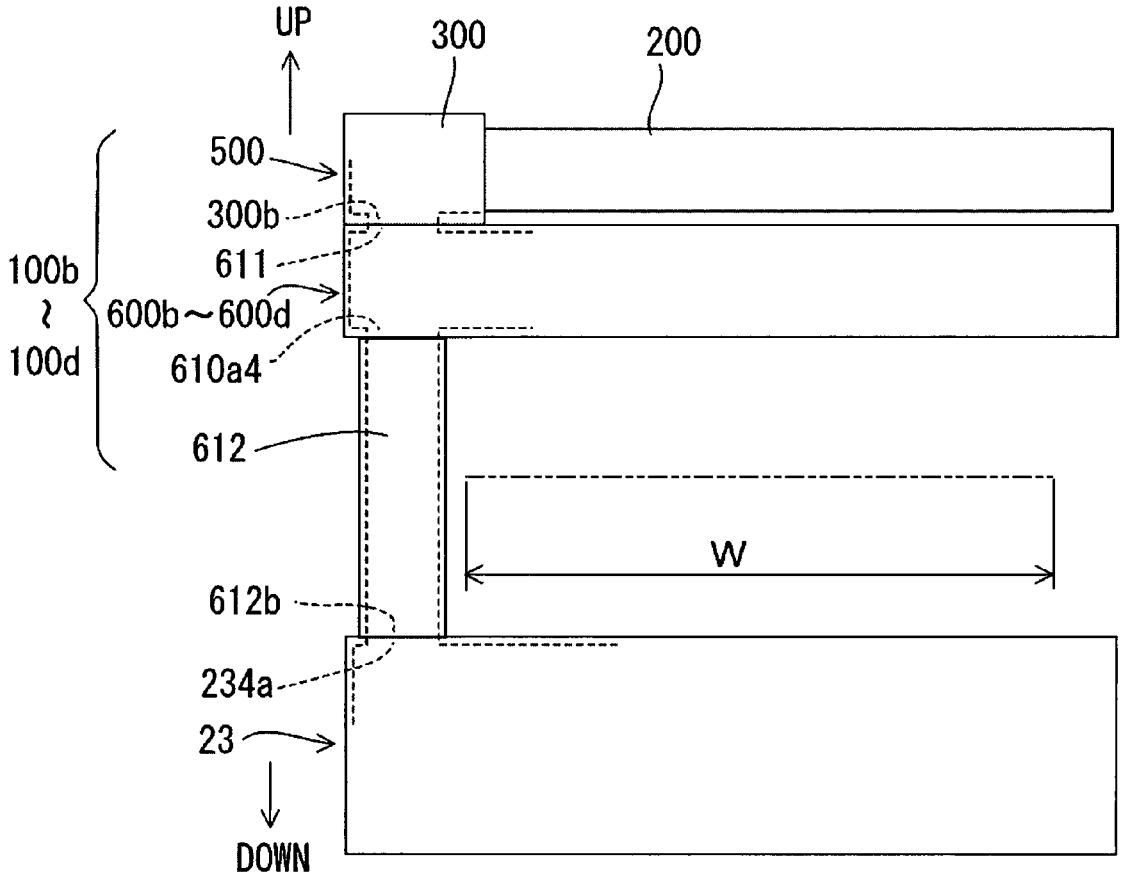
FIG. 3 is an overall front view showing the developing unit and toner supply device.

As shown in FIG. 1, the present embodiment is a developing unit 23 (23*a*, 23*b*, 23*c* or 23*d*) for use in an image forming apparatus 1 in which developer images are formed with developers (including toners) supplied from developing rollers 231 (231*a*, 231*b*, 231*c* and 231*d*) on photo receptor drums 21 (21*a*, 21*b*, 21*c* and 21*d*) in accordance with image data and transferred to a recording sheet by a transfer process, and each developing unit 23 includes a toner bottle 200 (200*a*, 200*b*, 200*c* or 200*d*: FIG. 3) for storing toner and a toner supply device 100 (100*a*, 100*b*, 100*c* or 100*d*) for supplying toner to developing unit 23 so as to perform image output by automatic toner supply to the developing unit 23.

As shown in FIG. 1, image forming apparatus 1 to which developing units 23 according to the present embodiment are mounted includes: a plurality of process printing units (image forming means) 20 (20*a*, 20*b*, 20*c* and 20*d*) each having a photoreceptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 for supplying the developer to the photoreceptor drum 21 surface; an exposure unit 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electrophotography with yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), cyan (C), magenta (M) and yellow (Y), are arranged sequentially along transfer belt 31.

These process printing units 20(20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), cyan (C), magenta (M) and yellow (Y), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), cyan (C), magenta (M) and yellow (Y) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d* are provided. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the toner to be supplied, toners of black (BK), cyan (C), magenta (M) and yellow (Y) colors are stored in toner supply assemblies 500*a*, 500*b*, 500*c* and 500*d*, respectively.

Here, two toner supply assemblies 500*a* for black (BK) developer are arranged side by side in order to support large-volume printing, taking into account the practice that monochrome printing is usually used most frequently.

Each toner supply assembly 500 is arranged at a position approximately directly above the developing unit 23 for performing development with the corresponding developer, and is connected to the corresponding developing unit 23 by means of a developer supply passage part 612 (612*a*, 612*b*, 612*c* or 612*d*).

Here, supply passage part 612*a* for supplying the black (BK) developer is constructed so that the developer from two toner supply devices 100*a* and 100*a* can be put together and supplied to developing unit 23*a*.

Cleaner unit 24 is arranged on the up stream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor drum 21 so as to scrape and collect the leftover toner off the photoreceptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade.

That is, any configuration may be used as long as it can scrape and collect the leftover toner off the photoreceptor drum 21.

Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, alight source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 may be displaced so that transfer belt 31 is inclined in either way from the fixing unit 27 side to the other of housing 1*a* while the photoreceptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33 and positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is a means for transferring the toner image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet that is fed from paper feed portion 109 toward the transfer roller 36 side by aligning the front end of the sheet with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause color contamination of toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the leftover toner, remained on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271.

A recording sheet is input from below fixing rollers 271 and output upward towards conveying roller 27*c*.

Above fixing unit 27*a* paper discharge roller 28 is arranged so that the recording sheet conveyed from conveying roller 27*c* is discharged by the paper discharge roller 28 onto paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located, below conveying roller 29*a* with respect to the top and bottom direction, and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image to the paper with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing 1*a* of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s feed direction of recording paper.

Pickup roller 42*a* touches one edge part of the surface of the topmost sheet of the recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photoreceptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause color contamination of toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108 located above.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with the toner image transferred thereon is conveyed approximately vertically and reaches fixing unit 27, where the toner image is thermally fixed to the recording sheet by heat roller 27*a* and pressing roller 27*b*.

When one-sided printing is requested, the recording sheet having passed through fixing unit 27 is discharged by discharge roller 28 and placed facedown on paper output tray 43.

In contrast, when double-sided printing is requested, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged onto paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 2:
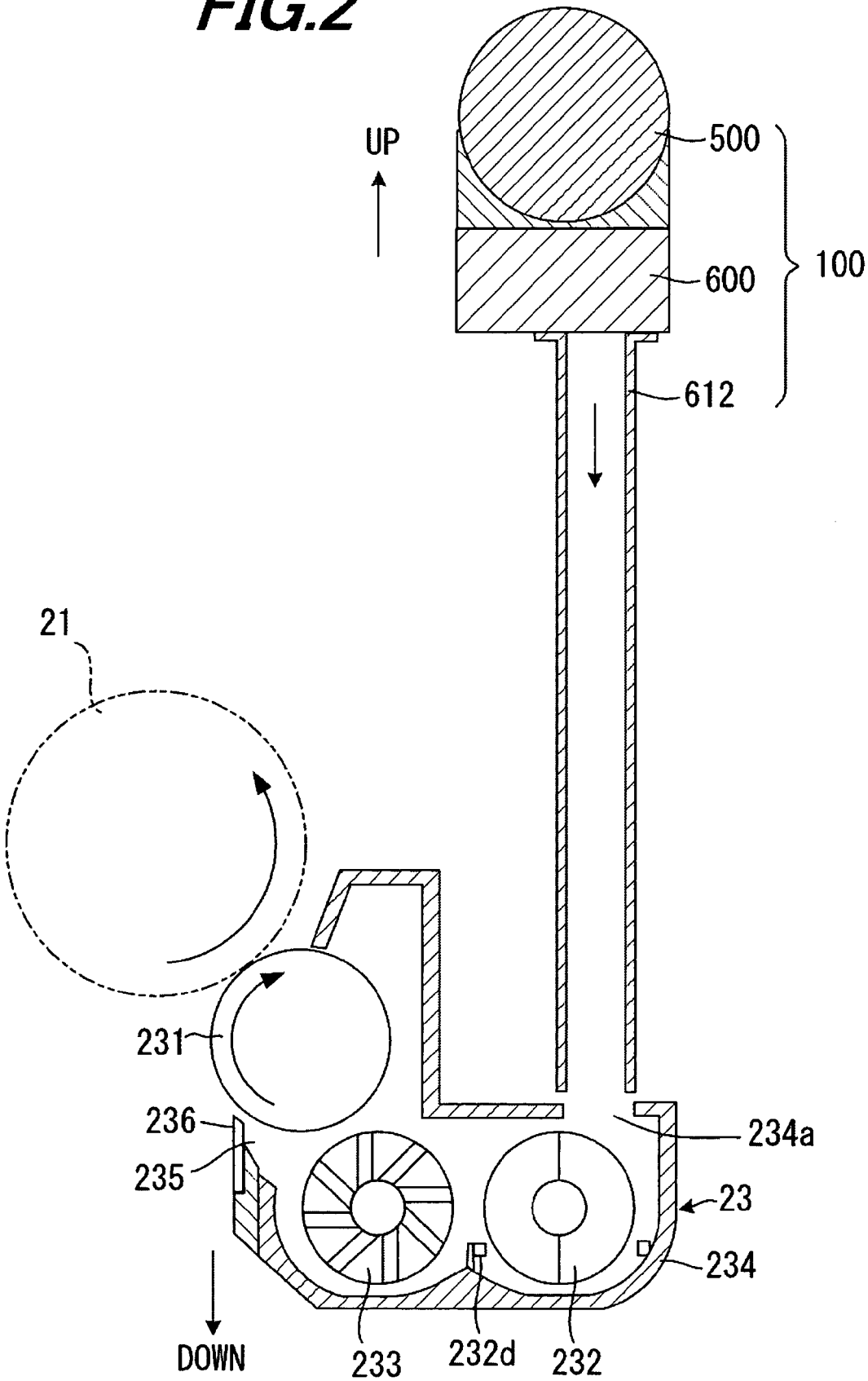
FIG. 2 is a schematic side sectional view showing a configuration of a developing unit and a toner supply device that constitute the image forming apparatus.
Figure 4:
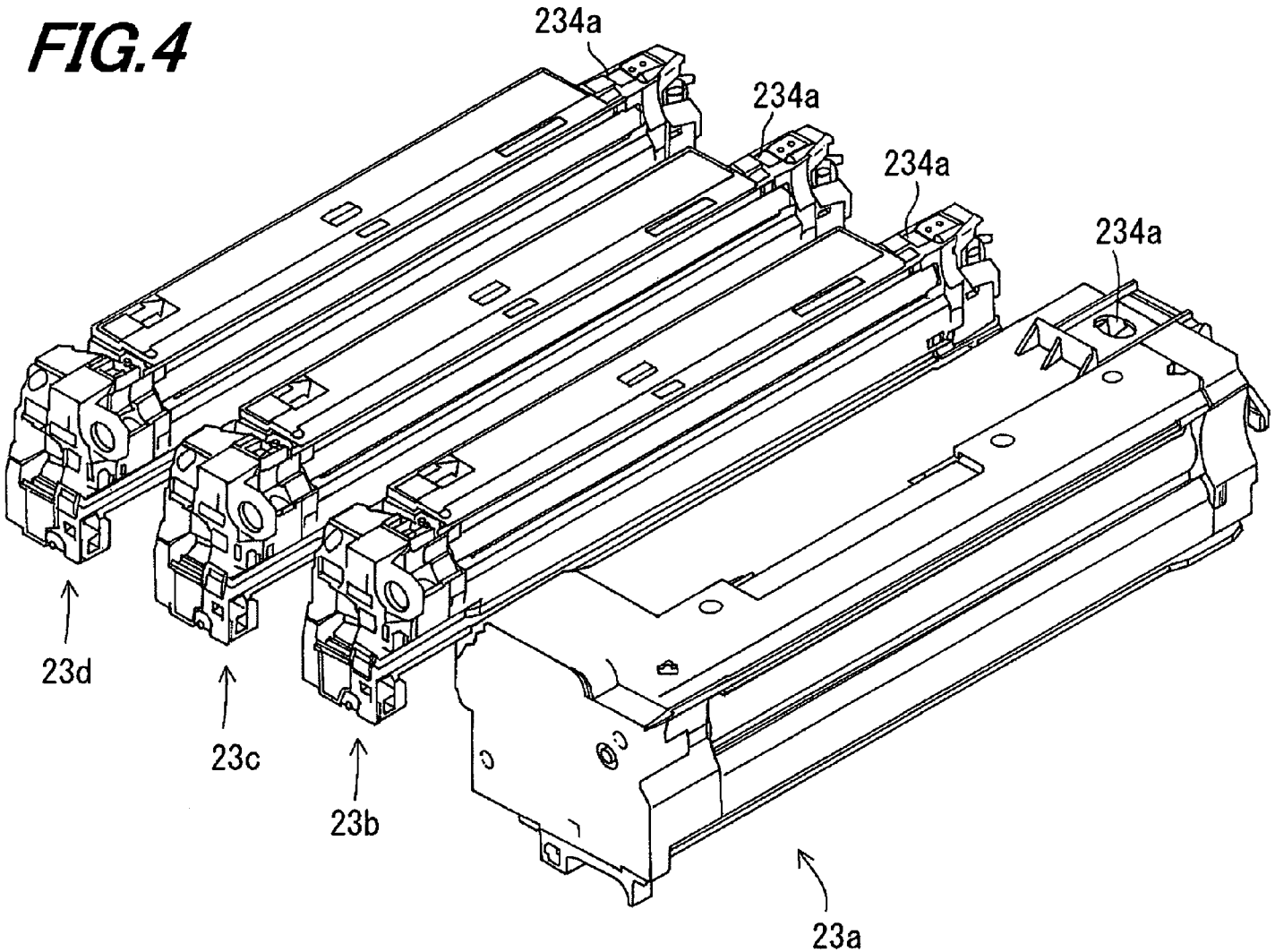
FIG. 4 is a perspective view showing the configuration of the developing unit.
Figures 5A, 5B, 5C, 5D, 5E, 5F:
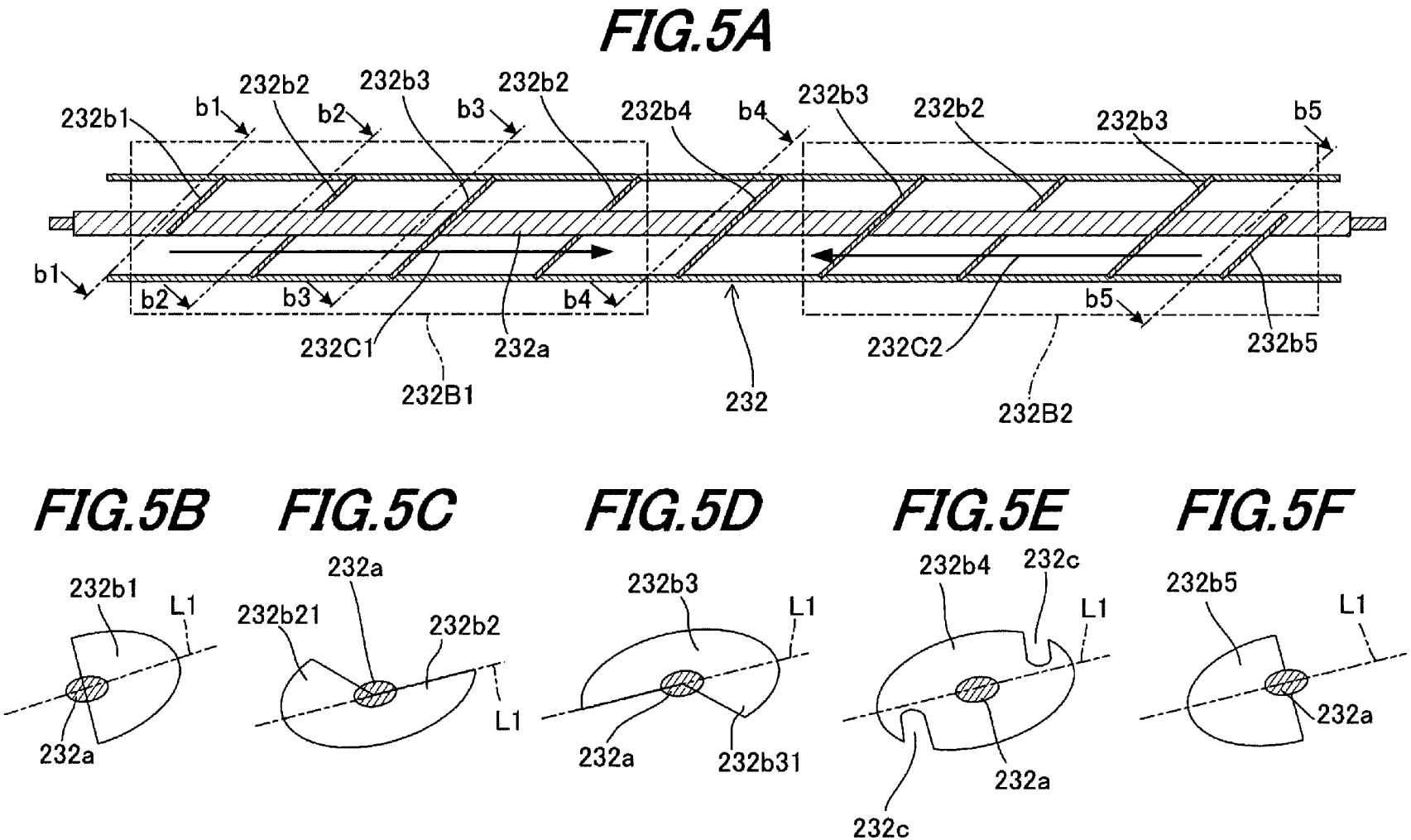
FIG. 5A is a sectional side view showing a configuration of an agitating and conveying means for the developing unit according to the present embodiment.
FIG. 5B is a view from a plane b1-b1 in FIG. 5A.
FIG. 5C is a view from a plane b2-b2 in FIG. 5A.
FIG. 5D is a view from a plane b3-b3 in FIG. 5A.
FIG. 5E is a view from a plane b4-b4 in FIG. 5A.
FIG. 5F is a view from a plane b5-b5 in FIG. 5A.

FIG. 2 is a schematic side sectional view showing a configuration of a developing unit and a toner supply device that constitute an image forming apparatus of the present embodiment; FIG. 3 is an overall front view showing the configuration of the developing unit and toner supply device; FIG. 4 is a perspective view showing the configuration of the developing unit mounted to the image forming apparatus according to the present embodiment; FIG. 5A is a sectional side view showing a configuration of an agitating and conveying means for the developing unit according to the present embodiment; and FIGS. 5B to 5F are illustrative views showing the structure of agitating vanes that constitute the agitating and conveying means, FIG. 5B being a view from a plane b1-b1 in FIG. 5A, FIG. 5C a view from a plane b2-b2 in FIG. 5A, FIG. 5D a view from a plane b3-b3 in FIG. 5A, FIG. 5E a view from a plane b4-b4 in FIG. 5A, and FIG. 5D a view from a plane b5-b5 in FIG. 5A.

To begin with, developing unit 23 will be described.

As shown in FIGS. 2 to 4, in developing unit 23, a toner input port 234*a* for leading toner is formed as an opening at the top of a casing (developer hopper) 234 that forms its exterior and holds toner. The developing unit incorporates inside casing 234 a developing roller 231, a first toner agitating and conveying rotor (agitating and conveying means) 232 and a second toner agitating and conveying rotor 233, and is mounted to the image forming apparatus body with the developing roller 231 opposed, in abutment with, or close to, photoreceptor drum 21. This toner input port 234*a* of developing unit 23 is formed at a position further outside of the width W of the transfer belt, on the same side as a toner feed port 611 of a toner supply assembly mounting mechanism 600 is disposed.

First toner agitating and conveying rotor 232 and second toner agitating and conveying rotor 233 are disposed in the bottom of casing 234 in parallel with each other along the axial direction of developing roller 231 so that the toner that is fed into casing 234 is agitated with the developer and conveyed to developing roller 231. Developing roller 231 is arranged over and above first toner agitating and conveying rotor 232 so as to be exposed from an opening mouth 235.

In casing 234 a toner concentration sensor 232*d* is disposed opposing and close to first toner agitating and conveying rotor 232 at the approximate center of the length of first toner agitating and conveying rotor 232, as shown in FIG. 2. Toner concentration sensor 232*d* is a transmission-type sensor that determines toner concentration by detecting toner density.

Now, the configuration of first agitating and conveying rotor 232 will be detailed with reference to the drawings.

First agitating and conveying rotor 232 is a structure that agitates and conveys toner fed from toner bottle 200 and is comprised of a rotary shaft 232*a* arranged approximately parallel to developing roller 231 and a plurality of separate plate-like agitating vanes (agitating elements) 232*b*1, 232*b*2, 232*b*3, 232*b*4 and 232*b*5, as shown in FIG. 5A.

Agitating vanes 232*b*1, 232*b*2, 232*b*3, 232*b*4 and 232*b*5 are equi-distantly arranged along the axis of rotary shaft 232*a* and angled in the same direction 45 degrees with the direction in which the axis of rotary shaft 232*a* extends. Detailedly, these vanes are arranged such that agitating vane 232*b*4 is disposed at the approximate center of rotary shaft 232*a*, and a group 232B1 of agitating vanes 232*b*1, 232*b*2, 232*b*3 and 232*b*2 and another group 232B2 of agitating vanes 232*b*3, 232*b*2, 232*b*3, 232*b*5 are separately arranged symmetrically left and right in the drawing with respect to the axial direction.

The agitating vane 232*b*1 arranged at one end side of rotary shaft 232*a* has a hemi-elliptic shape (with a hemi-elliptic shape cut out) which is bilaterally symmetrical about the longitudinal normal line (the line that passes through the center axis of rotary shaft 232*a* and is perpendicular to the tangent line to the outer periphery on the longer side of the agitating vane) L1 of the contour at the point on the major axis of the ellipse, as shown in FIG. 5B.

The agitating vane 232*b*5 that is arranged on the other end side of rotary shaft 232*a* has the same shape as agitating vane 232*b*1 and is attached to rotary shaft 232*a* in a position that is point symmetrical about the center of rotary shaft 232*a* to rotary vane 232*b*1, as shown in FIG. 5F.

In one word, agitating vane 232*b*1 and agitating vane 232*b*5 are attached to rotary shaft 232*a* with their phases shifted 180 degrees from each other (in opposition to each other).

Agitating vanes 232*b*1 and 232*b*5 are not limited to the hemi-elliptic shape but any shape is possible as long as they are bilaterally symmetrical about the longitudinal normal line L1.

Agitating vane 232*b*2 adjacent to agitating vane 232*b*1 is formed to be bilaterally asymmetrical about the longitudinal normal line L1 that passes through rotary shaft 232*a*, as shown in FIG. 5C.

In other words, agitating vane 232*b*2 is formed of a hemi-elliptic part cut by the normal line L1 and an agitating part 232*b*21 of a predetermined area (smaller than that of the hemi-elliptic part) contiguous to the hemi-elliptic part.

Herein, agitating vane 232*b*2 is formed to be bilaterally asymmetrical by forming a cutout on one side only with respect to the longitudinal normal line L1, but should not be limited to this. That is, it is also possible to create a bilaterally asymmetrical shape by forming cutouts that are continuous over both sides of longitudinal normal line L1 but different in size.

Agitating vane 232*b*3 adjacent to agitating vane 232*b*2 has the same shape as agitating vane 232*b*2 but is attached to rotary shaft 232*a* in a position that is point symmetrical about the center of rotary shaft 232*a* to rotary vane 232*b*2, as shown in FIG. 5D. In one word, agitating vane 232*b*3 is attached to rotary shaft 232*a* with its phase shifted 180 degrees from (in opposition to: or with its phase different from that of) agitating vane 232*b*2 with respect to rotary shaft 232*a*.

Detailedly, agitating vane 232*b*3 is formed to be bilaterally asymmetrical about the longitudinal normal line L1 that passes through rotary shaft 232*a*, and is formed of a hemi-elliptic part and an agitating part 232*b*31 of a predetermined area (smaller than that of the hemi-elliptic part) contiguous to the hemi-elliptic part.

Agitating part 232*b*31 of agitating vane 232*b*3 is formed at a position that is point symmetrical about the center of rotary shaft 232*a* to agitating part 232*b*21 of rotary vane 232*b*2.

Herein, agitating vane 232*b*3 is formed to be bilaterally asymmetrical by forming a cutout on one side only with respect to the longitudinal normal line L1, but should not be limited to this. That is, it is also possible to create a bilaterally asymmetrical shape by forming cutouts that are continuous over both sides of the normal line L1 but different in size In sum, it is approved as long as the area ratio between the left and right of normal line L1 is not 1:1.

Further, agitating vane 232*b*2 and agitating vane 232*b*3 are not needed to have the same shape.

Agitating vane 232*b*4 disposed at the approximate center with respect to the axial direction of rotary shaft 232*a* is formed to has an essentially elliptic shape as shown in FIG. 5E, having a cutout 232*c* at a position opposing toner concentration sensor 232*d* so as to permit the detection light from toner concentration sensor 232*d* to pass through. The same cutout 232*c* is formed at another position that is point symmetrical about the center of rotary shaft 232*a*.

Concerning the phase relationships between the continuous odd number of asymmetrical agitating vanes on the left side and those on the right side, when considering those from the ends to the approximate center of the axial direction of rotary shaft 232*a*, the odd number of asymmetrical agitating vanes (in the order of arrangement: 232*b*3-232*b*2-232*b*3) of group 232B2 and the odd number of asymmetrical agitating vanes (in the order of arrangement: 232*b*2-232*b*3-232*b*2) of group 232B1 are arranged asymmetrically (different in the order, different in phase, specifically, arranged their phases shifted 180 degrees from each other).

Though the shapes of the agitating vanes are specified by referring to bilateral symmetry and asymmetry about the longitudinal normal line L1 of the contour of the ellipse, the shapes are not limited to this. That is, the agitating vanes may have bilaterally symmetrical and asymmetrical shapes about the minor normal line (the line that passes through the center axis of rotary shaft 232*a* and is perpendicular to the tangent line to the outer periphery on the shorter side of the agitating vane) of the tangent of the contour of the ellipse. In this case, agitating vanes 232*b*1 and 232*b*5 are formed to be bilaterally symmetrical about the minor normal line and agitating vanes 232*b*2 and 232*b*3 are formed to be bilaterally asymmetrical about the minor normal line.

On the other hand, second agitating and conveying rotor 233 conveys the toner which was agitated and conveyed by first agitating and conveying rotor 232 to the developing roller 231 side as it is agitating the toner.

Casing 234 is a box-shaped configuration elongated in the direction (the width direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through this clearance.

Arranged over the thus constructed developing unit 23 is toner supply device 100.

Referring next to the drawings, the configuration of toner supply device 100 will be described.

Figure 6:
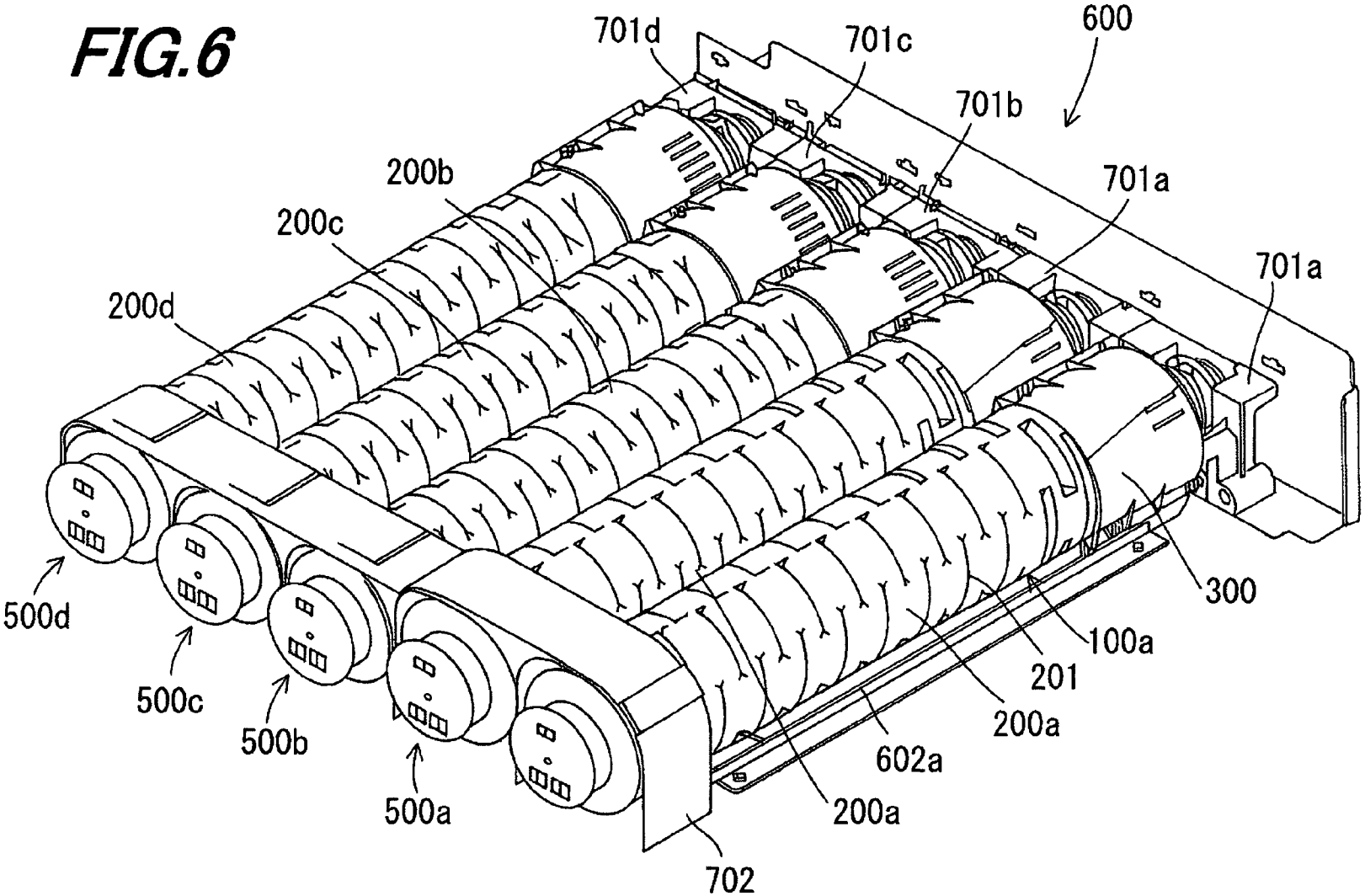
FIG. 6 is a perspective view showing a mounting example when toner supply assemblies are set in toner supply assembly mounting mechanisms that constitute the toner supply devices.
Figure 7:
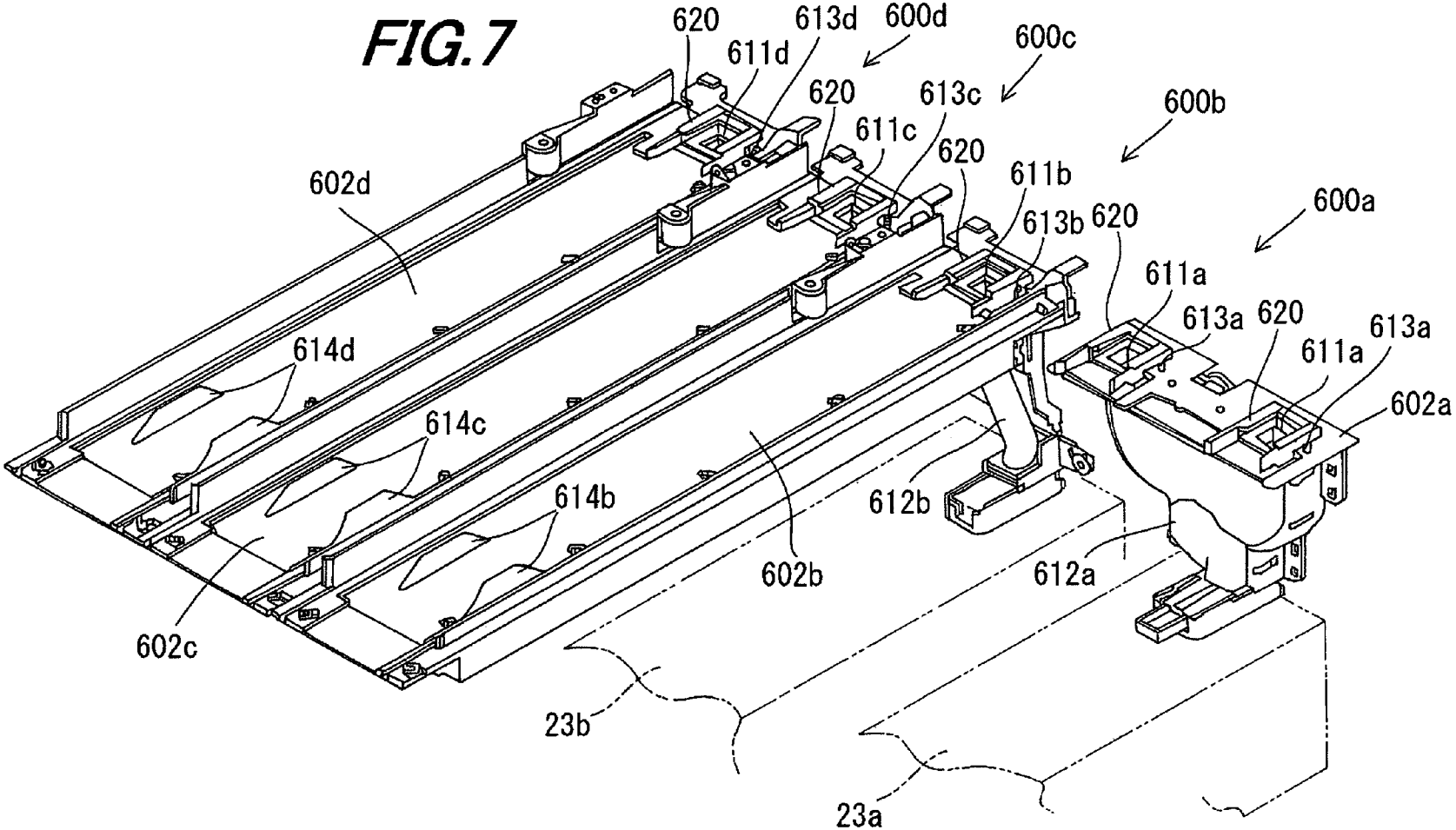
FIG. 7 is a perspective view showing the configuration of the toner supply assembly mounting mechanisms.
Figure 8A:
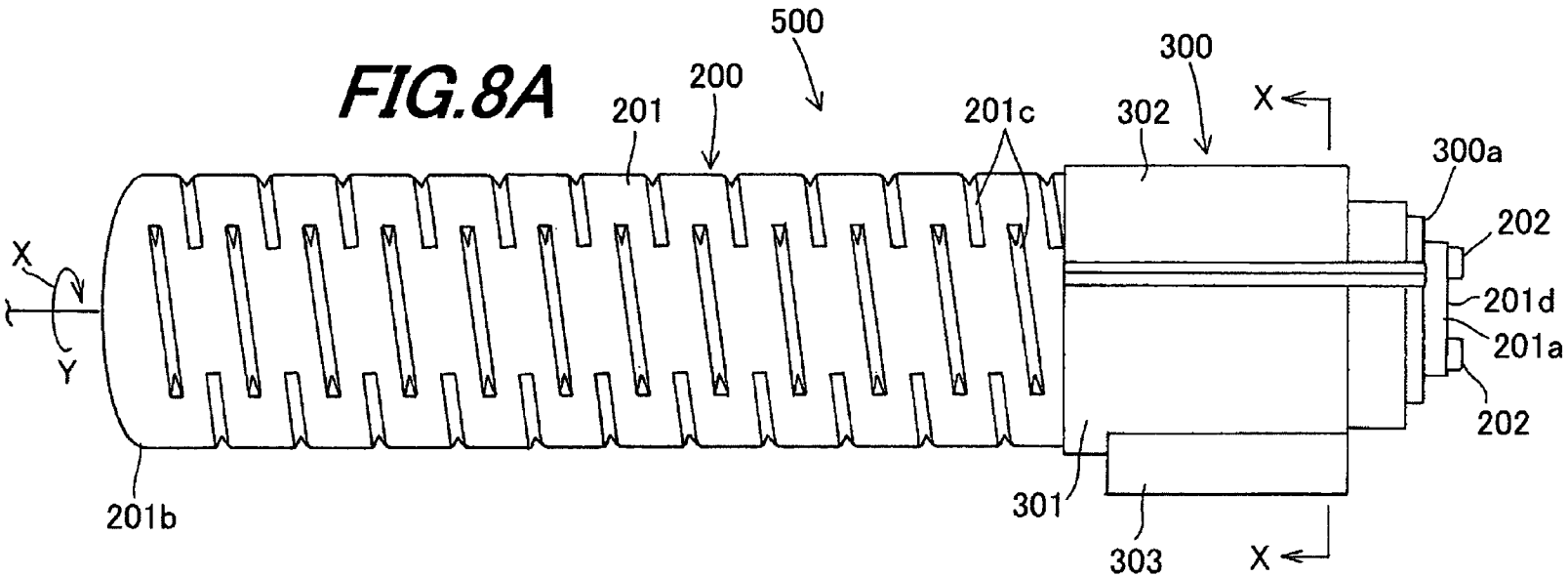
FIG. 8A is a side view showing a configuration of a toner supply assembly as a part of the toner supply device and FIG. 8B is its front view, viewed from the end face side of the toner supply assembly from which toner is supplied.

FIG. 6 is a perspective view showing a mounting example when toner supply assemblies are set in toner supply assembly mounting mechanisms that constitute the toner supply devices according to the present embodiment; FIG. 7 is a perspective view showing the configuration of the toner supply assembly mounting mechanisms; FIG. 8A is a side view showing a configuration of a toner supply assembly as a part of the toner supply device according to the present embodiment; and FIG. 8B is its front view, viewed from the end face side of the toner supply assembly from which toner is supplied.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 8A, toner supply device 100 is mainly composed of a toner bottle (toner container) 200 that stores toner as the developer, a toner supply assembly 500 having a bottle holder 300 that rotatably holds the toner bottle 200 at its one end, and a toner supply assembly mounting mechanism (toner feed device) 600 to which the toner supply assembly 500 is mounted so as to feed the toner to developing unit 300.

Figure 8B:
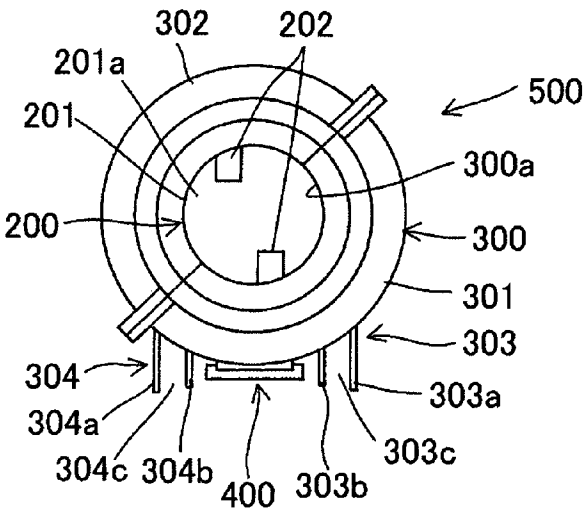

Provided on the bottom of bottle holder 300 (the lower side when toner supply device 100 is mounted in image forming apparatus 1) is a shutter mechanism 400 for opening and closing an aftermentioned toner discharge port for discharging the toner fed from toner bottle 200 to the outside of bottle holder 300, as shown in FIG. 8B.

Illustratively, when the toner discharge port of bottle holder 300 is opened by shutter mechanism 400, the toner discharge port and supply passage part 612 as a part of toner supply assembly mounting mechanism 600 are connected to each other so that the toner supplied from toner bottle 200 is fed to developing unit 23 by way of supply passage part 612 that is connected to developing unit 23.

To begin with, toner bottle 200 will be described.

As shown in FIG. 8A, toner bottle 200 is comprised of a main part 201 having an approximately cylindrical shape. When the end of main part 201 on the side supported by bottle holder 300 is called a front end part 201*a*, this front end part 201*a* is formed with an opening (described later) for discharging toner. The other end of main part 201 on the opposite side from front end part 201*a*, namely, rear end 201*b* is closed.

Formed on the peripheral side of main part 201 is a plurality of slots 201*c* which is depressed towards the rotational axis X. Here, on the interior side of main part 201, the parts corresponding to slots 201*c* form ribs that are projected towards the rotational axis X side.

The grooves formed between these ribs function as guide grooves for guiding the toner stored in main part 201 from rear end part 201*b* toward front end part 201*a*.

Herein, slots 201*c* are spirally formed as shown in FIG. 8A or inclined in such a manner that lower side in gravitational direction is inclined toward front end part 201*a* while upper side in anti-gravitational direction is inclined toward rear end part 201*b* so that they move toward front end part 201*a* when main part 201 rotates about the rotational axis X clockwise viewed from the front end side (in the Y-direction). With this configuration, as toner bottle 200 rotates in the Y-direction, the toner held in the toner bottle 200 can be conveyed from rear end 201*b* to front end part 201*a* of main part 201.

Here, slots 201*c* may have any shape as long as they can convey the toner stored in main part 201 from rear end part 201*b* toward front end part 201*a*.

Next, bottle holder 300 will be described.

As shown in FIGS. 8A and 8B, bottle holder 300 has an approximately cylindrical configuration, and is composed of a first casing 301 and second casing 302, joined to each other so as to cover front end part 201*a* of main part 201. At the end of the bottle holder 300 an opening 300*a* is formed so as to expose at least ribs 202 which are disposed at front end face 201*d* of front end part 201*a*.

Formed on the exterior of first casing 301 are a pair of plate-like first and second fixing structures (guide portions) 303 and 304 arranged parallel to each other, for fixing toner supply device 100 to image forming apparatus 1.

Shutter mechanism 400 for controlling discharge of the toner fed from toner supply device 100 to the outside is arranged between these first and second fixing structures 303 and 304, as shown in FIG. 8B.

Accordingly, in order to make shutter mechanism 400 function correctly, the heights of first and second fixing structures 303 and 304 are adjusted so as to assure a clearance between bottle holder 300 and image forming apparatus 1.

Further, as shown in FIG. 8A, in first fixing structure 303, a pair of rib pieces 303*a* and 303*b* is arranged a predetermined distance apart from one another, forming a guide portion 303*c* extending in the axial direction of toner bottle 200. Also in second fixing structure 304, a pair of rib pieces 304*a* and 304*b* is arranged similarly, forming a guide portion 304*c* along the axial direction.

Next, shutter mechanism 400 will be described with reference to the drawings.

Figure 9A:
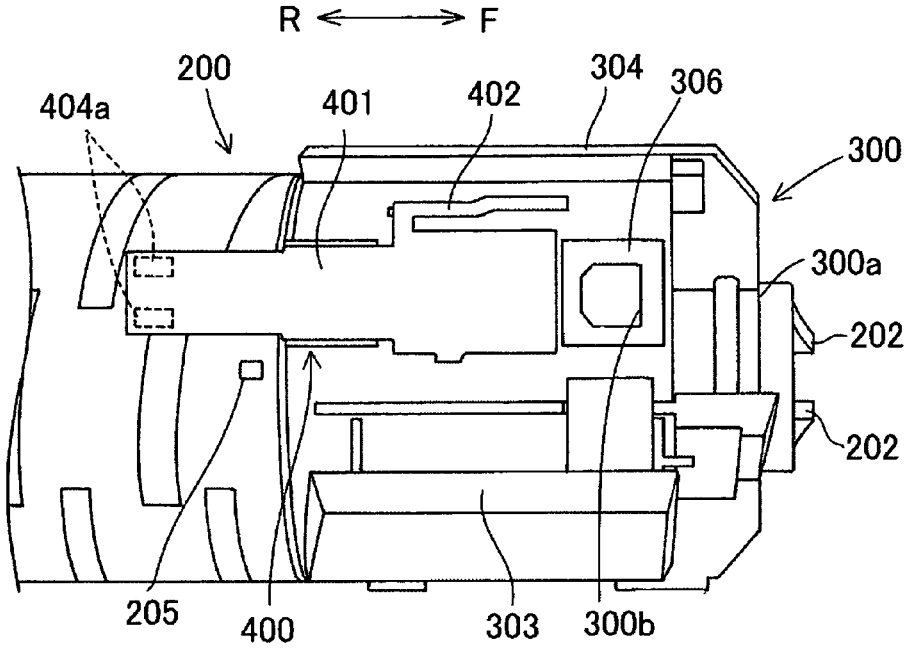
FIG. 9A is an illustrative view showing a bottle holder with its toner discharge port open.
Figure 9B:
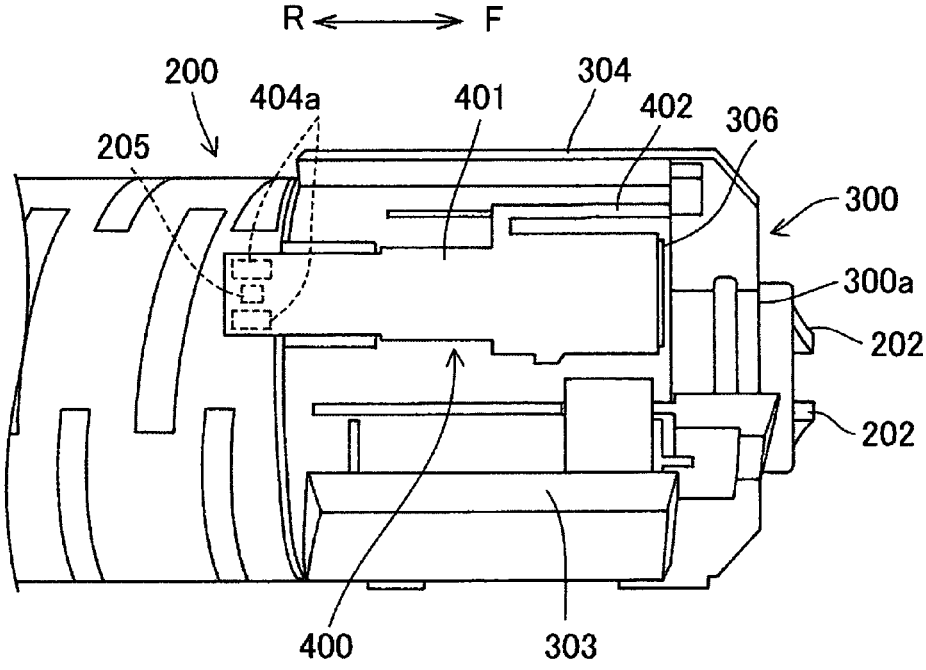
FIG. 9B is an illustrative view showing the bottle holder with the toner discharge port closed by a shutter mechanism.
Figure 10:
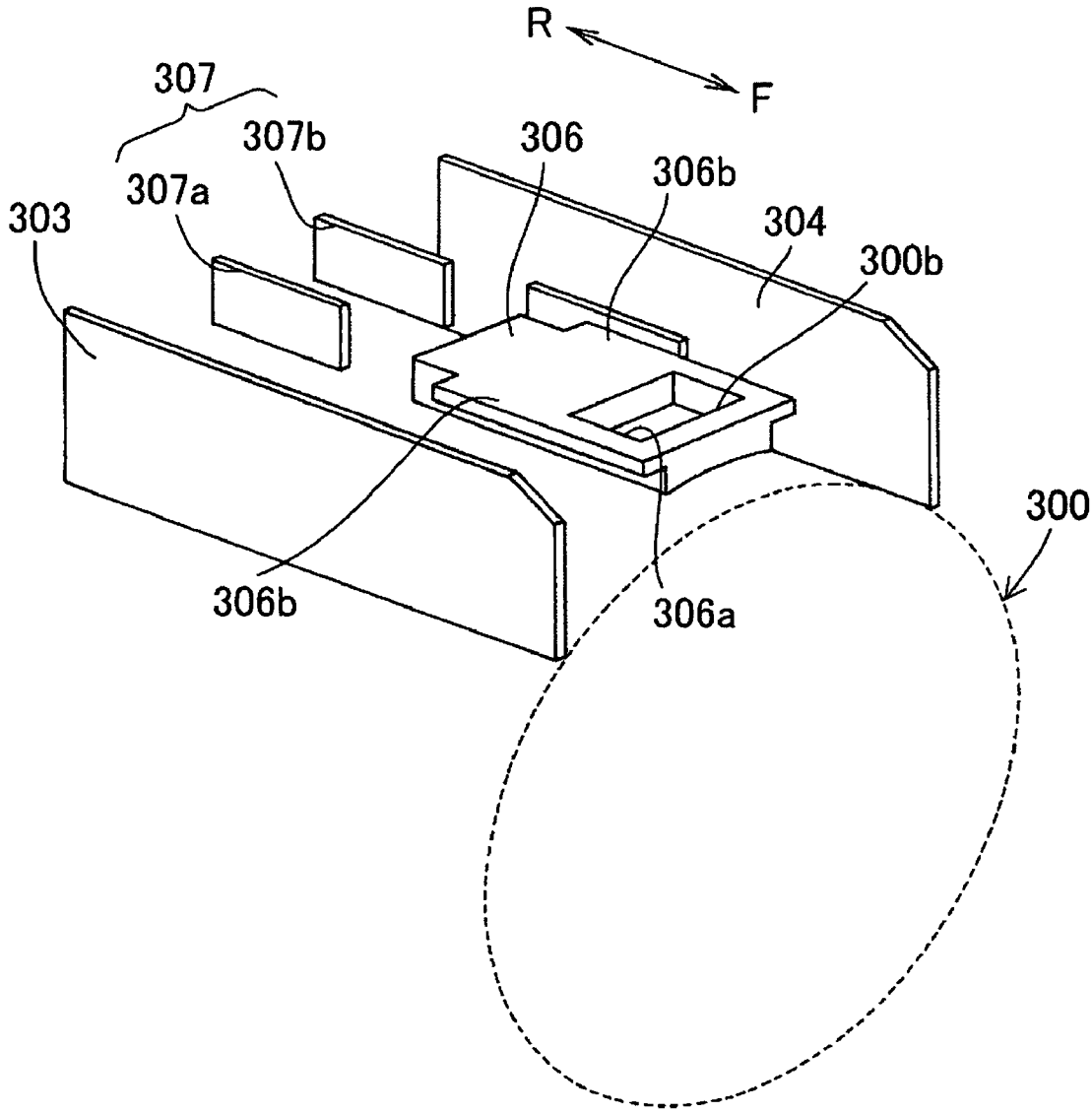
FIG. 10 is an illustrative view showing the schematic structure of the rear side of the bottle holder.

FIG. 9A is an illustrative view showing the bottle holder with its toner discharge port open, FIG. 9B is an illustrative view showing the bottle holder with the toner discharge port closed by a shutter mechanism, and FIG. 10 is an illustrative view showing the schematic structure of the rear side of the bottle holder.

As shown in FIGS. 9A and 9B, shutter mechanism 400 has a plate-like shutter member 401 that is slidable in the directions of arrows F and R, in the bottom of bottle holder 300. In the present embodiment, the side on which ribs 202, 202 of toner bottle 200 are projected from opening 300*a* at the front end of bottle holder 300 is called the front (F) side and the opposite is called the rear (R) side.

In shutter mechanism 400, as shutter member 401 slides in the direction of arrow R, toner discharge port 300*b* of bottle holder 300 is opened, as shown in FIG. 9A. When shutter member 401 slides in the direction of arrow F, toner discharge port 300*b* of bottle holder 300 is closed, as shown in FIG. 9B.

As shown in FIG. 10, bottle holder 300 is formed with first and second guide members306 and307 for guiding shutter member 401.

First guide member 306 is a flat plate-like member essentially parallel to the bottom surface of bottle holder 300 and is formed with an opening 306*a* that communicates with toner discharge port 300*b* of the bottle holder 300. Further, the side edge portions 306*b*, 306*b*, of first guide member 306, located at both sides with respect to the directions of arrows F and R, are formed to be thin with the attachment side to bottle holder 300 indented at both sides. These side edge portions 306*b*, 306*b* will function as guide rails for shutter member 401.

On the other hand, second guide member 307 consists of two guide plates 307*a* and 307*b* with their plate surfaces opposing each other, which are extended in the direction of arrow R on the downstream side, with respect to the direction of arrow R, of the attachment position of first guide member 306. These guide plates 307*a* and 307*b* will function as guide rails for shutter member 401.

Next, toner supply assembly mounting mechanism 600 will be described with reference to the drawings.

Figure 11:
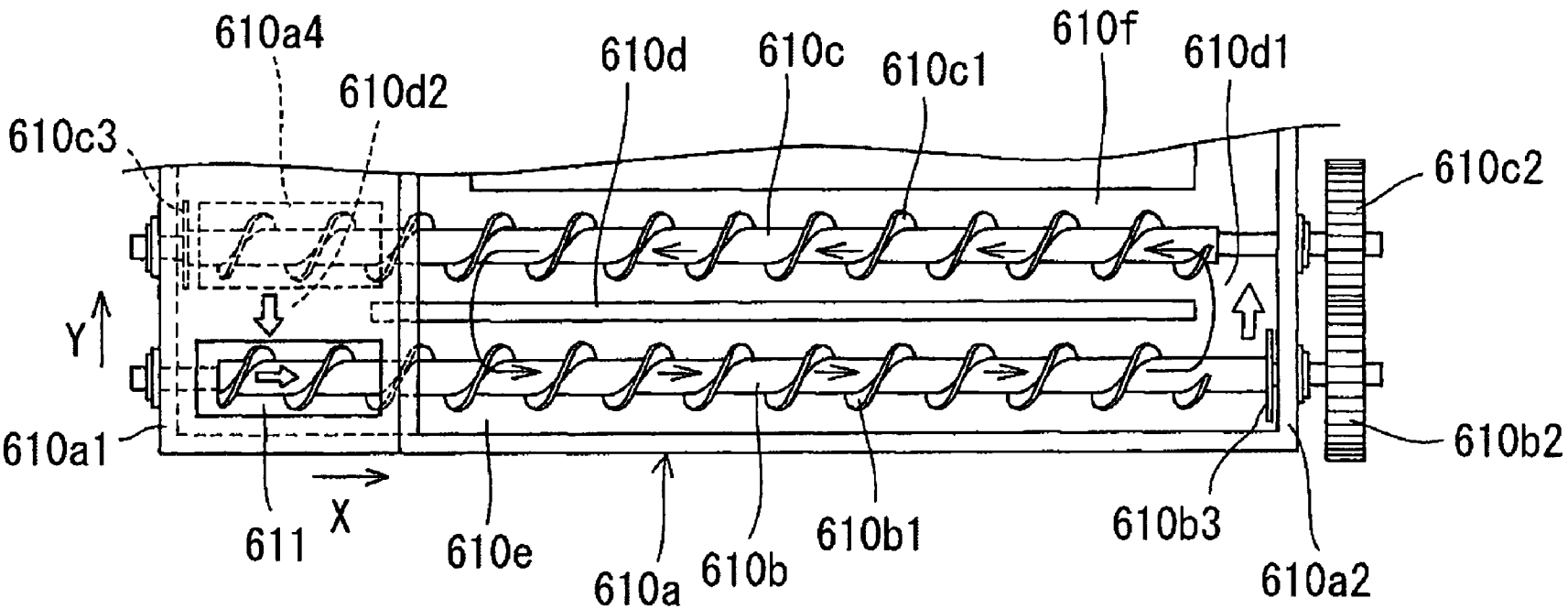
FIG. 11 is an illustrative view showing the structure of the toner supply assembly mounting mechanism.
Figure 12:
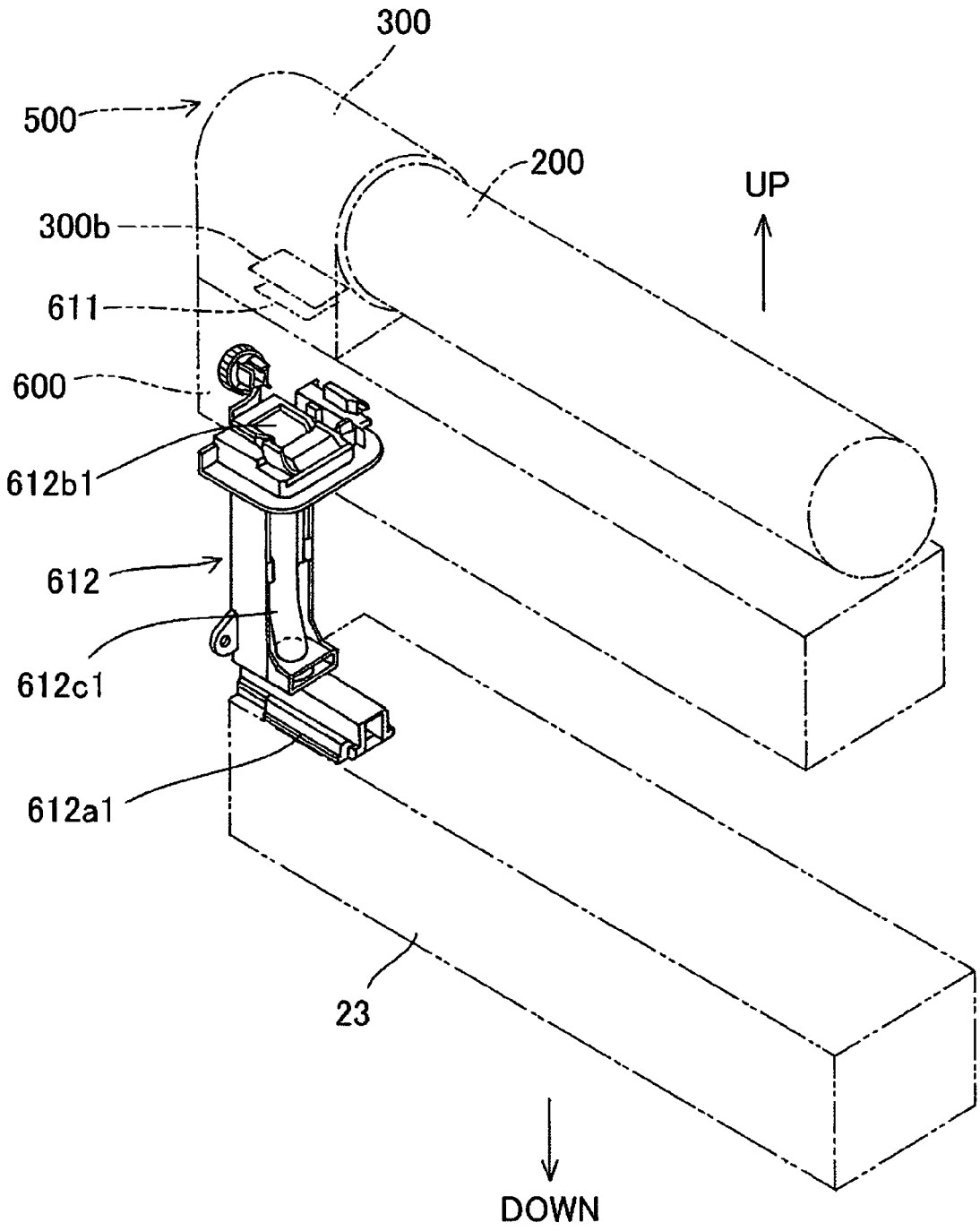
FIG. 12 is an illustrative view showing the structure of a supply passage part for coupling the toner supply assembly mounting mechanism with a developing unit.

FIG. 11 is an illustrative view showing the structure of the toner supply assembly mounting mechanism as a part of a toner supply device according to the present embodiment, and FIG. 12 is an illustrative view showing the structure of a supply passage part for coupling the toner supply assembly mounting mechanism with a developing unit.

As shown in FIGS. 1, 2, 5 and 6, toner supply assembly mounting mechanism 600 is constructed such that toner supply assembly 500 is disposed essentially parallel to, and opposing, developing unit 23 with transfer belt unit 30 disposed therebetween. Toner supply assembly mounting mechanism 600 is constructed so that two toner supply assemblies 500*a* for storing black toner can be mounted together.

In toner supply assembly mounting mechanism 600, mount bases 602 (602*a* to 602*d*: FIGS. 6 and 7) onto which toner supply assemblies 500 are mounted are formed lengthwise in the direction (the transfer belt width direction) approximately perpendicular to the transfer belt's direction of conveyance.

As shown in FIG. 6, toner supply assemblies 500 are fixed to corresponding drive mechanisms 701 (701*a* to 701*d*), respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with toner bottle 200's ribs 202 (FIGS. 8A and 8B) that are projected from opening 300*a* of the aforementioned bottle holder 300. Usually, the actuator is composed of a motor, and is controlled to drive in accordance with the condition of toner being supplied.

On the other hand, holding belt 702 (FIG. 6) is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, the mount base 602 on which toner supply assembly 500 is to be mounted, has a toner feed port 611 (611*a*, 611*b*, 611*c* or 611*d*) on the upper surface thereof as shown in FIG. 7. This toner feed port is disposed at one end side on the upper surface where bottle holder 300 of toner supply assembly 500 is mounted, correspondingly to shutter mechanism 400 for the bottle holder 300. On the underside of the mount base, supply passage part 612 (612*a*, 612*b*, 612*c* or 612*d*) for toner conveyance is provided to establish communication between the toner supply port 611 and developing unit 23 that is arranged under toner supply assembly mounting mechanism 600.

Here in FIG. 7, for description convenience, mount base 602*a* corresponding to toner supply assembly 500*a* of black toner is partially omitted.

Supply passage part 612*a* provided in mount base 602*a* for toner supply assembly 500*a* for black toner (FIG. 1) has two toner feed ports 611*a*, 611*a* corresponding to two toner supply assemblies 500*a*. That is, this supply passage part is constructed so as to receive toner fed from the two ports and feed the toner to single developing unit 23*a* for black toner through toner input port 234*a* (FIGS. 2 and 3) formed in developing unit 23*a*.

Each toner supply assembly mounting mechanism 600 is constructed as shown in FIGS. 3 and 11 such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

On the other hand, each of mount bases 602*b* to 602*d* of toner supply assemblies 500*b* to 500*d* for cyan, magenta and yellow toners is formed with a casing 610*a* (FIG. 11) that has a box shape elongated in the width direction of the transfer belt. The casing 610*a* incorporates a first toner agitator shaft 610*b* and a second toner agitator shaft 610*c*, arranged parallel to each other along the axis direction of developing roller 231 (FIG. 2).

The interior of casing 610*a* is divided into a first toner chamber 610*e* with first toner agitator shaft 610*b* disposed therein and a second toner chamber 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the direction of toner conveyance so as to receive the toner being conveyed.

Here, the toner agitating means should not be limited to screws 610*b*1 and 610*c*1, but it may be a structure in which a multiple number of agitating vanes tilted with the direction of toner conveyance are formed on the first and second toner agitator shafts 610*b* and 610*c*, for example. Also any other configuration can be used as long as it can achieve the same effect.

Partitioning element 610*d* is formed in casing 610*a* along the casing length or along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port 611 for receiving toner supply from toner bottle 200 arranged on the top thereof is formed while a toner feed port 610*a*4 for delivering the toner from casing 610*a* to supply passage part 612 (FIGS. 2 and 3) that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating and circulatively conveying toner from second end side 610*a*2 to first end side 610*a*1 of casing 610*a*.

Each supply passage part 612 is formed so that its top is integrated with toner supply assembly mounting mechanism 600, and a developing unit attachment portion 612*a* for detachable attachment to developing unit 23 is provided at the bottom thereof, as shown in FIG. 12.

An opening of a toner input port 612*b*1 for toner input is formed at the top of supply passage part 612, and a toner passage 612*c*1 for toner to pass from this toner input port 612*b*1 to developing unit attachment portion 612*a* is provided approximately linearly from top to bottom.

Further, as shown in FIG. 7, at one end side on the top of casing 610*a* of mount base 602, bottle holder guide portions 620, 620 that engage portions 303*c* and 304*c* (FIG. 8B) of first and second fixing structures 303 and 304 and guide them are projectively formed at the positions opposing first and second fixing structures 303 and 304 (FIG. 8B) of bottle holder 300 when toner supply assembly 500 has been mounted. Bottle holder guide portions 620, 620 are arranged essentially parallel to each other with toner feed port 611 positioned therebetween and extended in the longitudinal direction of mount base 602.

Toner feed port 611 of mount base 602 is formed at the position corresponding to shutter member 401 (FIG. 9A) of shutter mechanism 400 provided for bottle holder 300 when toner supply assembly 500 is mounted. In other words, toner feed port 611 is formed at a position so as to be able to receive toner discharged from toner discharge port 300*b* when the toner discharge port 300*b* of bottle holder 300 is released by shutter mechanism 400.

Formed in the vicinity of toner feed port 611 is a projection piece 613 (613*a* to 613*d*), which is hooked by a hooking portion (described later) of regulating member 402 (FIG. 9A) provided for shutter member 401 of shutter mechanism 400 to limit the movement of shutter member 401.

On the side longitudinally opposite to toner feed port 611 of mount base 602, a supporter 614 (614*a* to 164*d*) for supporting the rear end (the end on the side opposite to the mounted portion of bottle holder 300) of toner bottle 200 when toner supply device 100 is mounted is formed.

This supporter 614 is to create a predetermined clearance between toner bottle 200 and mount base 602 and functions to smoothen the rotation of toner bottle 200. Here, the configuration and the like of supporter 614 are not particularly limited; any configuration and material can be used as long as toner bottle 200 can rotate smoothly.

The forming position of projection piece 613 provided near toner feed port 611 is determined by the regulatory operation of regulating member 402.

Next, how the forming position of projection piece 613 is determined will be described with reference to the drawings.

Figure 13A:
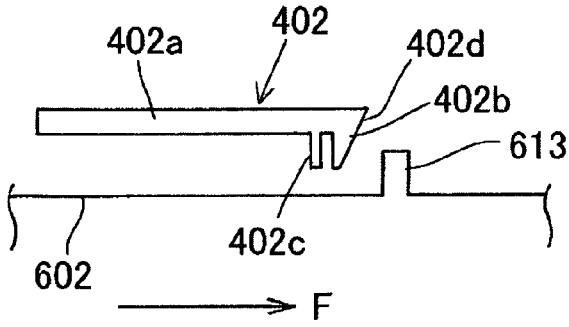
FIG. 13A is an illustrative view showing the positional relationship between a regulating member and a projection piece before the toner supply device is mounted to a mount base.
Figure 13B:
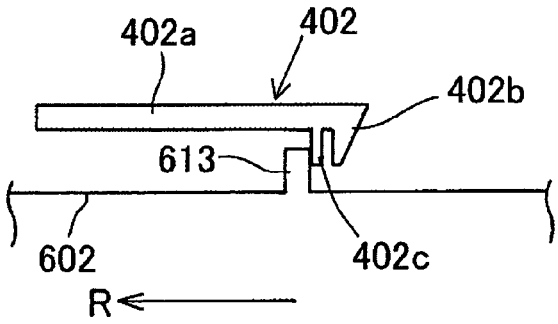
FIG. 13B is an illustrative view showing the positional relationship between the regulating member and the projection piece when the toner supply device has been mounted to the mount base.
Figure 13C:
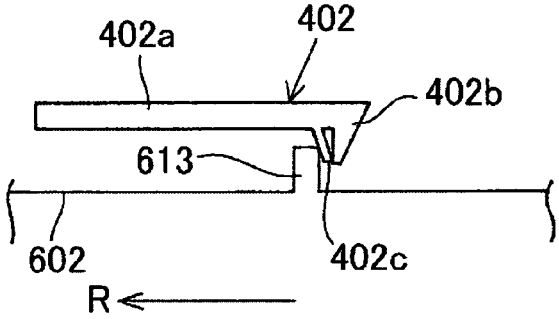
FIG. 13C is an illustrative view showing the positional relationship between the regulating member and the projection piece when the toner supply device is dismounted from the mount base; and, FIG. 14 is an illustrative view showing an overall configuration of a copier according to another embodiment of the present invention.

FIG. 13A is an illustrative view showing the positional relationship between the regulating member and the projection piece before the toner supply device according to the present embodiment is mounted to the mount base; FIG. 13B is an illustrative view showing the positional relationship between the regulating member and the projection piece when the toner supply device has been mounted to the mount base; and FIG. 13C is an illustrative view showing the positional relationship between the regulating member and the projection piece when the toner supply device is dismounted from the mount base.

Projection piece 613 is formed at such a position that shutter member 401 will open toner discharge port 300*b* of bottle holder 300 by its engagement with regulating member 402 when toner supply device 100 has been completely attached to mount base 602 and will close toner discharge port 300*b* of bottle holder 300 when toner supply device 100 is removed from mount base 602.

Regulating member 402 has first hook 402*b* and second hook 402*c* formed at the front end (on the side of engagement with projection piece 613) of main piece 402*a*, as already mentioned.

First hook 402*b* is disposed at a position more front than second hook 402*c* and its abutment surface 402*d* against projection piece 613 is formed beveled so that it can easily ride over the projection piece 613. Here, abutment surface 402*d* may be so inclined that its contact area with the top of projection piece 613 is minimized.

When abutment surface 402*d* of first hook 402*b* is inclined in this way, regulating member 402 is moved in the direction of arrow F from the state shown in FIG. 13A, and first hook 402*b* rides over projection 613 formed on first casing 301. With a further movement of the regulating member in the direction of arrow F, second hook 402*c* also rides over projection 613. From this state, when regulating member 402 is caused to move in the direction opposite to the direction of arrow F, movement of regulating member 402 is obstructed by projection piece 613 and second hook 402*c* (the state shown in FIG. 13B).

Next, how toner supply device 100 is mounted to the image forming apparatus will be described.

Toner supply device 100 is adapted to be mounted to toner supply assembly mounting mechanism 600 by sliding bottle holder 300 side of toner supply assembly 500 over and along mount base 602 of toner supply assembly mounting mechanism 600.

By this sliding movement of toner supply assembly 500, shutter member 401 of shutter mechanism 400, provided for bottle holder 300, opens or closes toner discharge port 300*b* of the bottle holder 300, as shown in FIGS. 9A and 9B.

Movement of shutter member 401 is controlled by regulating member 402 that is integrally formed with shutter member 401.

In the case where toner discharge port 300*b* of bottle holder 300 is opened by shutter mechanism 400, as shutter member 401 moves in the direction of arrow R, regulating member 402 moves and takes the state shown in FIG. 13B. Then, with a further movement in the direction of arrow R, second hook 402*c* abuts projection piece 613 and falls down to the first hook 402*b* side, as shown in FIG. 13C, so that the first hook 402*b* together with second hook 402*c* ride over projection piece 613 as the movement in the direction of arrow R continues. In this way, toner discharge port 300*b* of bottle holder 300 is released.

In the case where toner supply assembly 500 is dismounted from toner supply assembly mounting mechanism 600, as toner supply assembly 500 is pulled out from toner supply assembly mounting mechanism 600, the aforementioned actions take place in the reverse order, that is, shutter member 401 moves in the direction of arrow F (FIG. 13A) so that toner discharge port 300*b* of bottle holder 300 is closed.

Next, the operation of toner supply to developing unit 23 by toner supply device 100 will be described.

As shown in FIG. 3, in a case where toner is supplied to developing unit 23, as toner bottle 200 is rotated by drive mechanism 701 (701*a* to 701*d*: FIG. 6), the toner discharged from toner bottle 200 is supplied from the interior of bottle holder 300 to toner supply assembly mounting mechanism 600. The toner is then agitated by the toner supply assembly mounting mechanism 600 and supplied to developing unit 23.

The toner supplied to developing unit 23 is conveyed, as being agitated, toward developing roller 231 by first agitating and conveying rotor 232 and second agitating and conveying rotor 233.

Next, toner agitation and conveyance in developing unit 23 will be described with reference to the drawings.

In developing unit 23, the toner supplied from toner bottle 200 or the toner stored in casing 234 is conveyed as it is being agitated by first agitating and conveying rotor 232, as shown in FIG. 5A.

With first agitating and conveying rotor 232 in which the agitating vanes are bounded into two groups 232B1 and 232B2 by the agitating vane 232*b*4 located at the approximate longitudinal center of rotary shaft 232*a*, the toner is agitated and conveyed by agitating vanes 232*b*1, 232*b*2, 232*b*3 and 232*b*2 on the group 232B1 side and by agitating vanes 232*b*3, 232*b*2, 232*b*3 and 232*b*5 on the group 232B2 side.

On the group 232B1 side including agitating vanes 232*b*1, 232*b*2, 232*b*3 and 232*b*2, toner is conveyed as it is being agitated by two asymmetrical agitating vanes 232*b*2 to the right in FIG. 5A while toner is conveyed to the left in FIG. 5A as it is being agitated by single asymmetrical agitating vane 232*b*3 that is out of phase (asymmetrical) with agitating vane 232*b*2. Accordingly, the agitated toner is as a whole conveyed in the direction of arrow 232C1 (FIG. 5A) by the conveying function of two asymmetrical agitating vanes 232*b*2 and single asymmetrical agitating vane 232*b*3.

On the other hand, on the group 232B2 side including agitating vanes 232*b*3, 232*b*2, 232*b*3 and 232*b*5, toner is conveyed as it is being agitated by two asymmetrical agitating vanes 232*b*3 to the left in FIG. 5A while toner is conveyed to the right in FIG. 5A as it is being agitated by single asymmetrical agitating vane 232*b*2 that is out of phase (asymmetrical) with agitating vane 232*b*3. Accordingly, the agitated toner is as a whole conveyed in the direction of arrow 232C2 (FIG. 5A) by the conveying function of two asymmetrical agitating vanes 232*b*3 and single asymmetrical agitating vane 232*b*2.

With this arrangement, it is possible to agitate and convey the toner that resides near the inner wall portion and hence is unlikely to be circulated in casing 234 (FIG. 2), toward the center of casing 234. Then the thus brought toner in the center of casing 234 can be further agitated by agitating vane 232*b*4 at the center of first agitating and conveying rotor 232 so that the toner distribution can be made uniform.

As described above, the toner which has been agitated and conveyed by first agitating and conveying rotor 232 (FIG. 2) is further agitated and conveyed to the developing roller 231 side by second agitating and conveying rotor 233 (FIG. 2).

Thus, the toner uniformly agitated in casing 234 can be supplied to photoreceptor drum 21 by means of developing roller 231.

According to the present embodiment constructed as above, toner in casing 234 can be agitated highly efficiently and circulated with a multiple number of agitating vanes 232*b*1, 232*b*2, 232*b*3, 232*b*4 and 232*b*5 formed on first agitating and conveying rotor 232, without causing stagnation of toner at both side walls of casing 234, hence it is possible to supply uniformly agitated toner to developing roller 231. This enables developing roller 231 to supply photoreceptor drum 21 with uniformly agitated toner, thus making it possible to form high-quality images.

Here, in the present embodiment, five types of agitating vanes 232*b*1, 232*b*2, 232*b*3, 232*b*4 and 232*b*5 are used as the agitating elements for first agitating and conveying rotor 232, and these agitating vanes are classified into to groups 232B1 and 232B2, left and right in the drawing with agitating vane 232*b*4 positioned at the center of the length of rotary shaft 232*a*, each group including three agitating vanes 232*b*2 and 232*b*3 in total. However, in the present invention, the types and number of agitating vanes are not limited to the above and the agitating elements are not limited as to shape and number, as long as the rotor includes an odd number of asymmetrical plate-like agitating vanes arranged on either side in an alternate manner so as to convey toner toward the center of the agitated range.

Though the present embodiment has been described taking an example in which developing unit 23 according to the present invention is applied to the image forming apparatus shown in FIG. 1, the present invention should not be limited to this. For example, the developing unit may be applied to a copier 101 as shown in FIG. 14.

Figure 14:
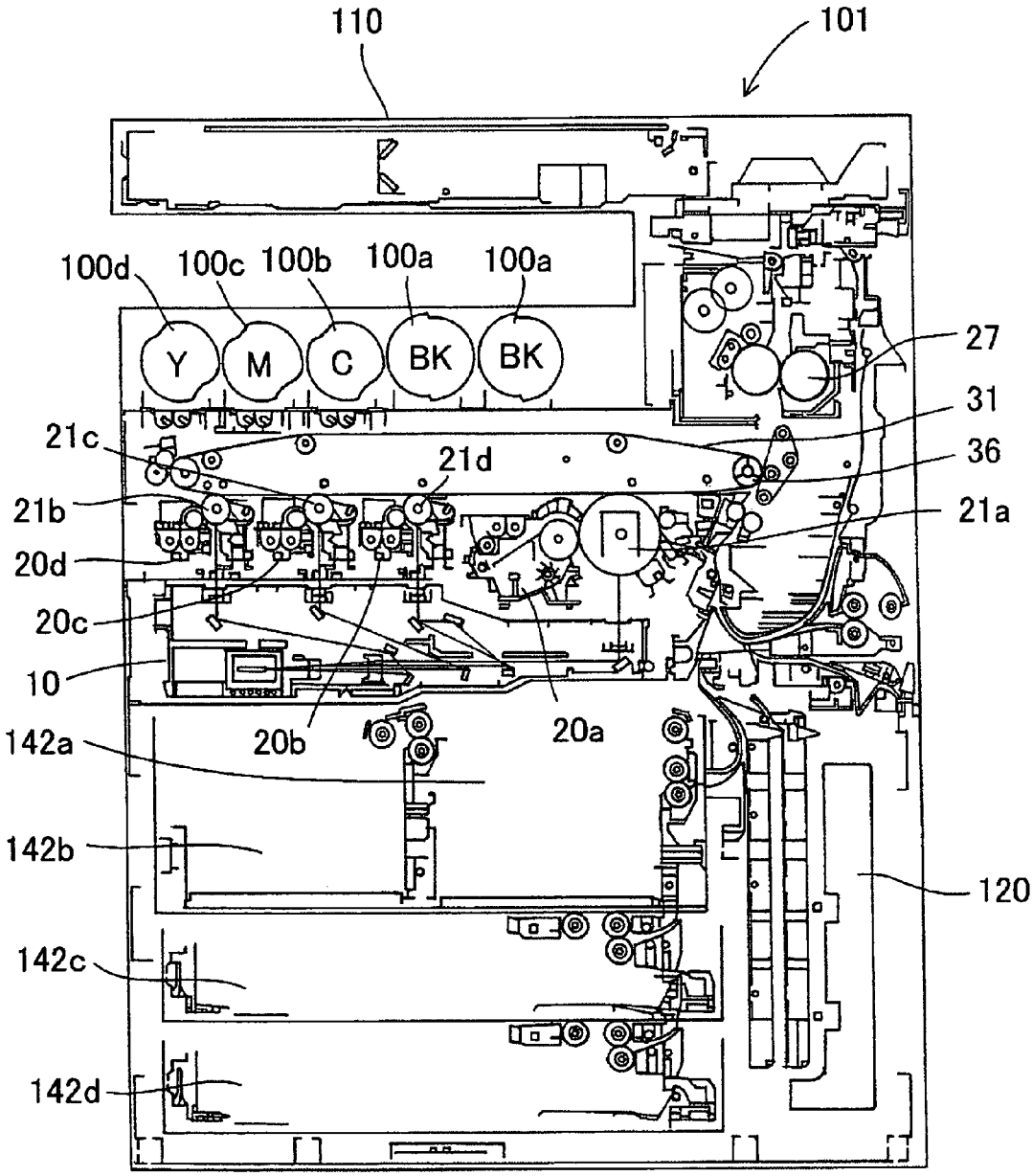

As shown in FIG. 14, copier 101 includes an image reader (scanner) 110 disposed above an image forming portion 108 having almost the same configuration as that of image forming apparatus 1 according to the present embodiment, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing.

In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

Further, the present invention can be developed into any form of other kinds of apparatuses, not limited to the image forming apparatus and copier having the above configurations, as long as it includes a developing unit.

As has been described above, the present invention should not be limited to the above embodiment and examples, and various changes can be made within the range specified in the scope of claims. That is, any embodied mode obtained by combination of technical means modified as appropriate without departing from the spirit and scope of the present invention should be included in the technical art of the present invention.

What is claimed is:

1. A developing unit comprising:

an agitating and conveying portion for conveying a developer stored in a developing hopper while agitating the developer; and a developing roller for supplying the developer conveyed from the agitating and conveying portion to an electrostatic latent image bearer, characterized in that the agitating and conveying portion comprises a rotary shaft arranged approximately parallel to the developing roller and a plurality of separate plate-like agitating elements arranged with an inclination with respect to the extended direction of axis of the rotary shaft;

each of an odd number of agitating elements arranged in series among the plural agitating elements is formed in a shape asymmetrical with respect to a normal line that is perpendicular to the tangent of the contour of the corresponding agitating element and passes through the rotational center of the rotary shaft; and the agitating elements adjacent to each other in the odd number of agitating elements are arranged on the rotary shaft with their phases made different.

2. The developing unit according to claim 1, wherein the odd number of agitating elements arranged in series are formed as a first set on the first side and a second set on the second side, on both sides, bounded at the approximate center of the agitated area of the agitating and conveying portion;

the order of arrangement of the agitating elements in the second set with respect to the direction toward the approximate center is asymmetrical to that of the agitating elements of the first set; and the first and second sets are adapted to convey the developer toward the approximate center.

3. The developing unit according to claim 1, further comprising a toner concentration sensor disposed close to the agitating and conveying portion, wherein the agitating element disposed close to the toner concentration sensor is formed with a cutout at a position opposing the toner concentration sensor.

4. The developing unit according to claim 1, wherein the agitating elements arranged at both ends of the agitating and conveying portion are each formed in a hemi-elliptic shape with symmetry about the normal line.

5. The developing unit according to claim 1, wherein the agitating element at the approximate center of the rotary shaft among the multiple agitating elements is formed as an approximate circular plate.

6. The developing unit according to claim 1, wherein the agitating elements are arranged with an inclination of 45 degrees with respect to the axial direction of the rotary shaft.

* * * * *